US011268294B2

(12) United States Patent
Lindsay

(10) Patent No.: US 11,268,294 B2
(45) Date of Patent: Mar. 8, 2022

(54) SNAP FIT POSTS FOR FENCE PANELS BALUSTRADES AND THE LIKE

(71) Applicant: SAS SYSTEMS AUSTRALIA PTY LTD, Maroochydore (AU)

(72) Inventor: Leslie James Lindsay, Crows Nest (AU)

(73) Assignee: SAS SYSTEMS AUSTRALIA PTY LTD, Maroochydore (AU)

( * ) Notice: Subject to any disclaimer, the term of this patent is extended or adjusted under 35 U.S.C. 154(b) by 787 days.

(21) Appl. No.: 15/674,598

(22) Filed: Aug. 11, 2017

(65) Prior Publication Data

US 2017/0370121 A1 Dec. 28, 2017

Related U.S. Application Data

(63) Continuation of application No. PCT/AU2016/000038, filed on Feb. 13, 2016.

(30) Foreign Application Priority Data

Feb. 13, 2015 (AU) ..... 2015900469

(51) Int. Cl.

| | |
|---|---|
| ***E04H 17/20*** | (2006.01) |
| ***E04F 11/18*** | (2006.01) |
| ***E04H 17/14*** | (2006.01) |

(52) U.S. Cl.

CPC ..... *E04H 17/20* (2013.01); *E04F 11/1817* (2013.01); *E04F 11/1842* (2013.01); *E04F 2011/1819* (2013.01); *E04H 17/1469* (2021.01)

(58) Field of Classification Search

CPC ..... E04F 11/1817; E04F 11/1842; E04F 2011/1819; E04F 2011/1821;

(Continued)

(56) References Cited

U.S. PATENT DOCUMENTS 1,376,150 A * 4/1921 Miller ..... E04F 11/181 256/65.11
3,485,006 A * 12/1969 Rozario ..... E04F 11/1817 256/65.02

(Continued)

FOREIGN PATENT DOCUMENTS

| | | |
|---|---|---|
| AU | 2006230672 B1 | 4/2007 |
| CN | 202347920 U | 7/2012 |
| WO | 2007022571 A1 | 3/2007 |

*Primary Examiner* — Josh Skroupa
(74) *Attorney, Agent, or Firm* — Mark David Torche; Patwrite Law

(57) ABSTRACT

A post for a fit together panel comprising at least one said post and at least one slat, the post comprising a base member and a cover member, the cover member comprising a pair of sidewalls and an interconnecting end wall, the interconnecting end wall containing a plurality of openings through which the end of a slat can pass, the sidewalls adapted for extension over the channel member, the base member comprising a base wall and opposed sidewalls, at least one sidewall comprising a clamping leg adapted for clamping engagement against the end of a said slat passing through a said opening in the cover member, and snap fitting means on the channel member and/or the cover member to enable the channel member and the cover member to be snap fitted together.

13 Claims, 12 Drawing Sheets

(58) Field of Classification Search
CPC ..... E04F 2011/1827; E04F 2011/1831; E04H 17/1413; E04H 17/1443; E04H 17/168; E04H 17/20; E04H 2017/1456; E04H 2017/1469; E04H 2017/1486; E04H 17/1456; E04H 17/1469; E04H 17/1486
USPC ..... 256/65.02, 65.04, 65.05, 65.06, 65.11, 256/65.12
See application file for complete search history.

(56) References Cited

U.S. PATENT DOCUMENTS 3,955,799 A * 5/1976 Lauzier ..... E04F 11/1817 256/65.11
3,973,756 A * 8/1976 Lauzier ..... E04F 11/181 256/65.11
4,014,520 A 3/1977 Walters
4,027,855 A * 6/1977 Lauzier ..... E04F 11/1844 256/65.11
4,266,757 A 5/1981 Kirkwood
4,334,671 A * 6/1982 De Guise ..... E04F 11/181 256/65.12
4,346,872 A * 8/1982 Tornya ..... E04F 11/181 256/65.02
4,586,697 A * 5/1986 Tornya ..... E04F 11/181 256/65.11
4,805,879 A * 2/1989 Spera ..... E04F 11/1844 256/65.12
6,752,385 B2 * 6/2004 Zen ..... E04F 11/1817 256/65.01
7,384,025 B2 * 6/2008 Lo ..... E04H 17/1439 256/65.12
8,833,737 B2 * 9/2014 Langenwalter ..... E04H 17/1426 256/67
9,797,158 B2 * 10/2017 Springborn ..... E04H 17/1421
9,908,207 B2 * 3/2018 Springborn ..... E04H 17/1417
2003/0196395 A1 * 10/2003 Forbis ..... E04F 11/1817 52/300
2011/0024060 A1 2/2011 Brownbill
2015/0300041 A1 * 10/2015 Feeko ..... E04H 17/1421 256/65.12

* cited by examiner

SNAP FIT POSTS FOR FENCE PANELS BALUSTRADES AND THE LIKE

CROSS REFERENCE TO RELATED APPLICATIONS

This application is the U.S. national phase of international application PCT/AU2016/000038 filed Feb. 13, 2016 which designated the U.S., and claims the priority of Australian patent application No. 2015900469 filed Feb. 13, 2015, the entire contents of both of which are hereby incorporated by reference.

TECHNICAL FIELD

The present invention is directed extruded aluminum members which are comprised of parts that snap fit together without requiring any screws or rivets. Such members can be used in the construction of assemblies such as post and rail fences, fence panels and balustrades and the like to improve ease of manufacture and installation.

BACKGROUND OF THE INVENTION

Any references to methods, apparatus or documents of the prior art are not to be taken as constituting any evidence or admission that they formed, or form part of the common general knowledge.

Aluminum panels comprising spaced apart post members and an array of spaced apart parallel slat members which are snap fitted together without separate fasteners are quite common and find popularity due to their aesthetic appeal, clean lines, and resistance to weathering and corrosion. Popular uses for such panels include fence panels and screens.

Australian patent application 2006230672 illustrates a known type of snap together aluminum panel. This panel comprises unitary post members into which slots are cut and edges of slat members pass into the slots. The slats are held in the posts by clamping legs/fins. The post and clamping legs are formed as a single piece typically by extrusion.

This type of panel assembly suffers from a number of disadvantages. One disadvantage is in the increase cost of manufacture of the post containing the cutouts. The cutouts are formed using a computer controlled cutting machine such as a CNC router. This is a complex and relatively expensive manner in which to provide cutouts.

Another disadvantage is that the clamping legs/fins can lose their memory over time. The reason for this is that the "hinge" part of the legs comprises the area where the legs extend from an inner wall of the post, and this area (the hinge area) is relatively small and therefore more likely susceptible to fatigue over time. Should this occur, the slats can move or slip or begin to rattle and it may be necessary to replace the entire post.

Another disadvantage with this type of panel is that it is quite difficult to fit the panel into a desired position. For example, panels may be required to be located between brick or block uprights. In that case the panels need to be fastened to the uprights using masonry anchors or something similar. The design of the panel is such that an internal masonry anchor cannot be used as there is no access to the internal back wall of the panel post. Thus, external brackets may need to be used which can be unsightly. Alternatively, a masonry anchor can be drilled entirely through the post which leaves a visible anchor point which is also unsightly.

Another disadvantage is that if there is any damage to a particular slat, it becomes necessary to remove the entire post from the brick or block uprights (for example). Refitting of a new post can be time-consuming and may require drilling of new openings in the uprights.

There is a need for improved snap-fit members which are composed of at least two parts that can be fastened together readily for use in the construction of assemblies such as fences, fence panels, balustrades and the like and which can overcome at least some of the above-mentioned disadvantages or which can provide a commercial choice in the marketplace.

SUMMARY OF THE INVENTION

According to a first aspect of the present invention there is provided a post comprising:

a base member and a cover member having corresponding snap fit formations by which the base member and the cover member are fastened to each other, the cover member including an end wall with first and second buttressing walls projecting therefrom, the base member comprising a base wall with first and second clamping legs extending therefrom for clamping a third member therebetween, the clamping legs converging outwardly and inwardly from the base wall to present a minimum space therebetween;

at least one opening formed through the base wall or the end wall for passage of a third member therethrough;

wherein the third member is oversized relative to the minimum space between the first and second clamping legs whereby forcing the third member through the minimum space urges portions of the clamping legs against walls of the cover member to thereby assist in retaining the cover member fast with the base member.

In a first embodiment of the invention the buttressing walls comprise sidewalls that extend over opposed sides of the base member. In this embodiment the at least one opening for passage of the slat is formed through the cover member. In this first embodiment the snap fit formations comprise inwardly projecting lips formed along the opposed sidewalls and corresponding rebates formed along outer edges of the base wall.

In a second embodiment of the invention the base wall further includes first and second sidewalls extending from opposed sides of the base walls with the first and second clamping legs being located between the first and second sidewalls.

Preferably, in the second embodiment remote ends of the first and second sidewalls are snap fitted to opposed sides of the cover.

It is preferred that in the second embodiment the buttressing walls and the clamping legs have portions that snap-fit together. For example, the clamping legs may be formed with outwardly disposed first grooves that receive corresponding inwardly projecting first lips of the buttressing walls.

Preferably the first and second clamping legs terminate in respective tapering portions to assist in guiding the third member there between in use. It is also preferable that the first and second clamping legs be formed with second outwardly disposed grooves that engage with corresponding inwardly projecting second lips of the buttressing walls during clamping of the third member.

In a third embodiment of the present invention first and second lateral wings extend from distal ends of the first and second sidewalls wherein outer edges of the lateral wings are formed with snap fit formations for receiving a balustrade or other cover. The snap fit formations may include a slot having a side formed as an undercut adjacent a tapering ridge whereby the tapering ridge assists in installing an edge of a balustrade into the slot.

A post arrangement according to an embodiment of the invention, such as that illustrated in FIGS. 1 and 2 provides several advantages. Firstly, fitment of the panel to a surround is straightforward in that the base member can be easily screwed or otherwise fastened to the surround prior to attachment of the cover member. Secondly, if a slat is damaged and needs to be replaced, the slat and the cover member can be removed while keeping the base member fixed to the surround. That is, it is no longer necessary to remove the entire post to replace a slat. Thirdly, the openings in the cover member (through which the slats pass) no longer need to be routed or otherwise cut through the cover member using expensive machinery. Because the cover member can be substantially U-shaped or C shaped, a simple punch die can be used to form the openings as both sides of the interconnecting wall are now available for the punching operation. Fourthly, by having the clamping legs forming part of (and typically essentially the entire) side wall of the base member, the "hinge area" is much more robust and there is much less likelihood of fatigue and loss of memory.

Another advantage of the post according to the present invention is that the base member profile can remain the same for slats of different sizes as all that is required is to provide a different cover member with larger or smaller openings (depending on the size of the slats) and which can be snap fitted to the base member.

Another advantage is that should there be damage to a clamping leg on the base member; the base member can be replaced without requiring replacement of the entire post.

In another form, the invention resides in a panel comprising at least one post as described above and at least one slat.

Throughout the specification, the term "panel" will be used to include but not limited to fencing, gates, awnings, window screens, other types of screens, and fixed louvres.

The term "post" is meant to be interpreted broadly and to include any type of elongate member to which slats or other members can be fitted. The post may be positioned substantially vertically in use, substantially horizontally in use, or possibly at some other angle. The post may be an end post or an intermediate post.

The post will typically be formed of aluminum and typically from extruded aluminum as this is a common process. However, there may be circumstances where the post is made from materials other than aluminum such as plastics, or from metals other than aluminum, or from laminate materials and the like. If the post is formed from aluminum, the aluminum may be treated for corrosion resistance and the treatment may include anodizing, powder coating, painting and the like.

The length of the post can vary, typically, depending on the size of the panel to be formed. It is envisaged that the usual length of the post will be between 40 cm (for instance a screen for a small toilet window) up to 2 or 3 m for a larger fence screen. The post may comprise a single post member or may comprise a number of post members connected together by any suitable means. For instance, the post members may be connected using an internal sleeve type fixing, or an external socket type arrangement or using fasteners or welding and the like. If post members are to be connected together, it is highly preferred that this is done in an aesthetically pleasing manner.

The post will typically be formed from two parts being the base member and the cover member and that can be snap fitted together.

The base member may be of any suitable length and width and have any suitable thickness depending on the size and shape of the panel to be formed and whether the panel will subject to high wind loading, twisting or other types of forces on the panel. It is envisaged that the base member will have a width and a depth of between 10 mm up to 200 mm. Similarly, it is envisaged that the wall thickness of the base member (depending on material) will be between 1-10 mm.

The base member will typically be substantially U-shaped comprising a base wall and a pair of upstanding sidewalls. However, there may be circumstances where the channel member may have a curved base wall. There may be circumstances where the base wall may have other configurations, inter alia, for aesthetic reasons, for functional reasons (for instance the post may be used as balustrading) or for fitment reasons (for instance the support may include a recess or rebate in which the base wall fits).

The sidewalls preferably have a width which approximates the width of the sidewalls of the cover member such that when the base member is attached to the cover member, the sidewalls extend substantially through the cover member towards the base wall of the cover member. This can improve the clamping action to the slats since the side walls of the cover member may act as buttresses or buttress walls and assist in holding the clamping legs of the base member firmly against the slat.

The clamping leg may comprise a turned in portion of each side wall. It is preferred that substantially the entire side wall assists in the clamping action against the slat and this will be described in greater detail below. There may be circumstances where each side wall contains more than one turned in portion and may be circumstances where only one side wall contains a turned in portion.

The end wall of the cover member is formed with a plurality of openings through which the end of slats can pass. Because the cover member can comprise a simple U-shaped type profile, it is possible to form the openings using a simple punch die which greatly improves manufacturing speed and reduces manufacturing cost. The number of openings will depend on the number of slats that are to be accommodated. The shape of the openings will depend on the shape of the slats that are to be accommodated. It is envisaged that the openings will be substantially identical or, for decorative or strength purposes, some openings may be larger or smaller than others to provide a panel having larger and smaller slats.

Some form of snap fitting means is provided on the base member and/or the cover member to enable these parts to be snap fitted together. In one form, the snap fitting means may comprise small turned in lips on the cover member which engage into small rebates or recesses on the base member. Alternatively, the base member may be formed with small turned in lips and the cover member may be formed with small rebates or recesses.

The slats will typically comprise extruded aluminum members. Such members are well-known. These members are usually substantially hollow. It is however possible for the members to be filled with foam or other material to improve strength properties, insulation properties, sound deadening properties and the like. The slats may also comprise materials other than aluminum. For instance, the slats may be formed from solid or hollow plastics. It is envisaged that the slats may also comprise wood or wood laminate slats. The slats may comprise a number of smaller parts attached together to form the slat. The slat may be formed from laminated material or other built-up materials. It is envisaged that the slats may also be formed from a grid like or mesh like material to provide security and ventilation. The slats may be formed from substantially clear material. It is also envisaged that the slats may have end brackets or end pieces adapted to pass into the openings on the post.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DETAILED DESCRIPTION OF THE INVENTION

Figure 1:
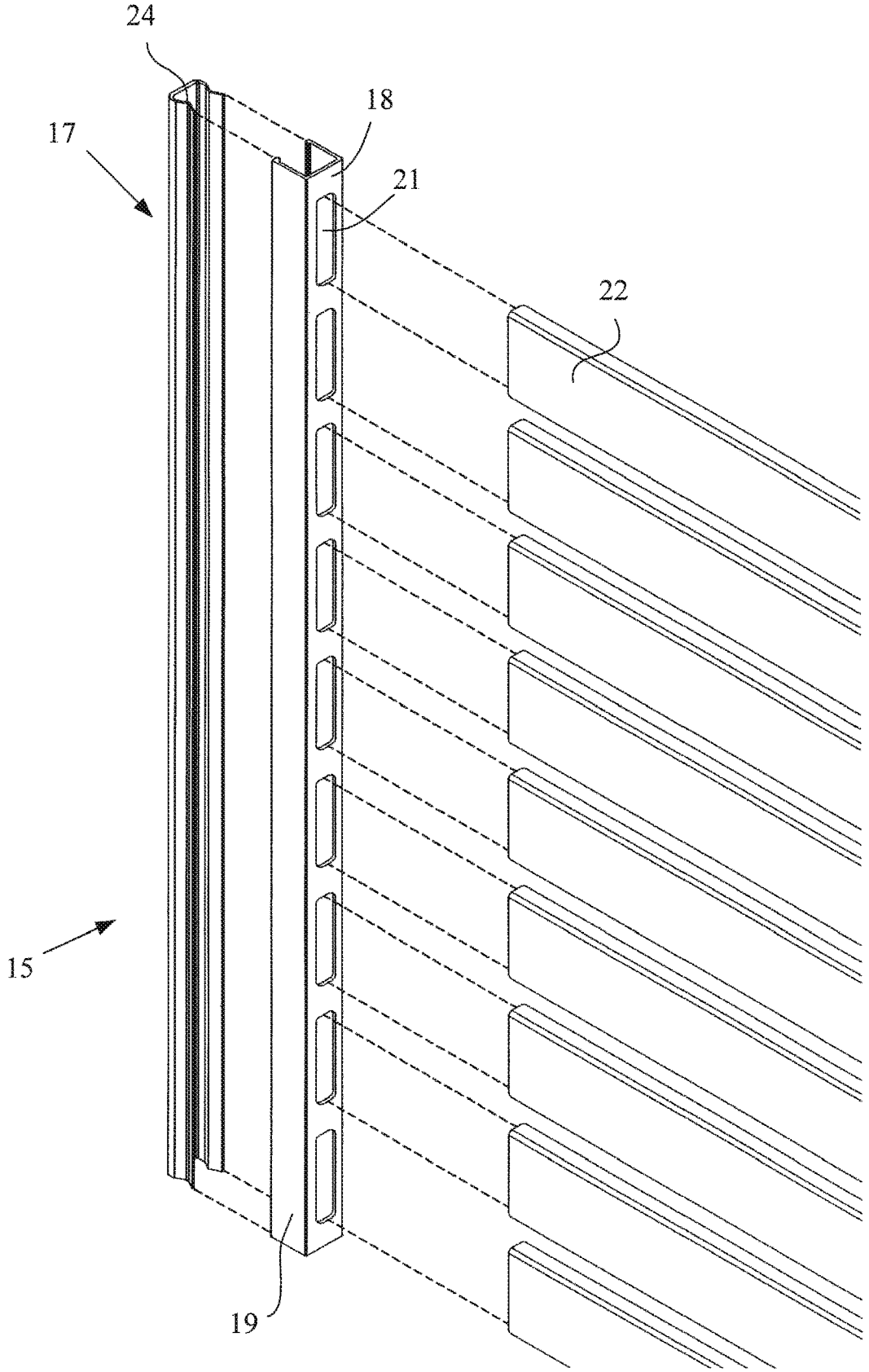
FIG. 1. Illustrates an exploded view of a panel containing slats and a post according to an embodiment of the invention.
Figure 2:
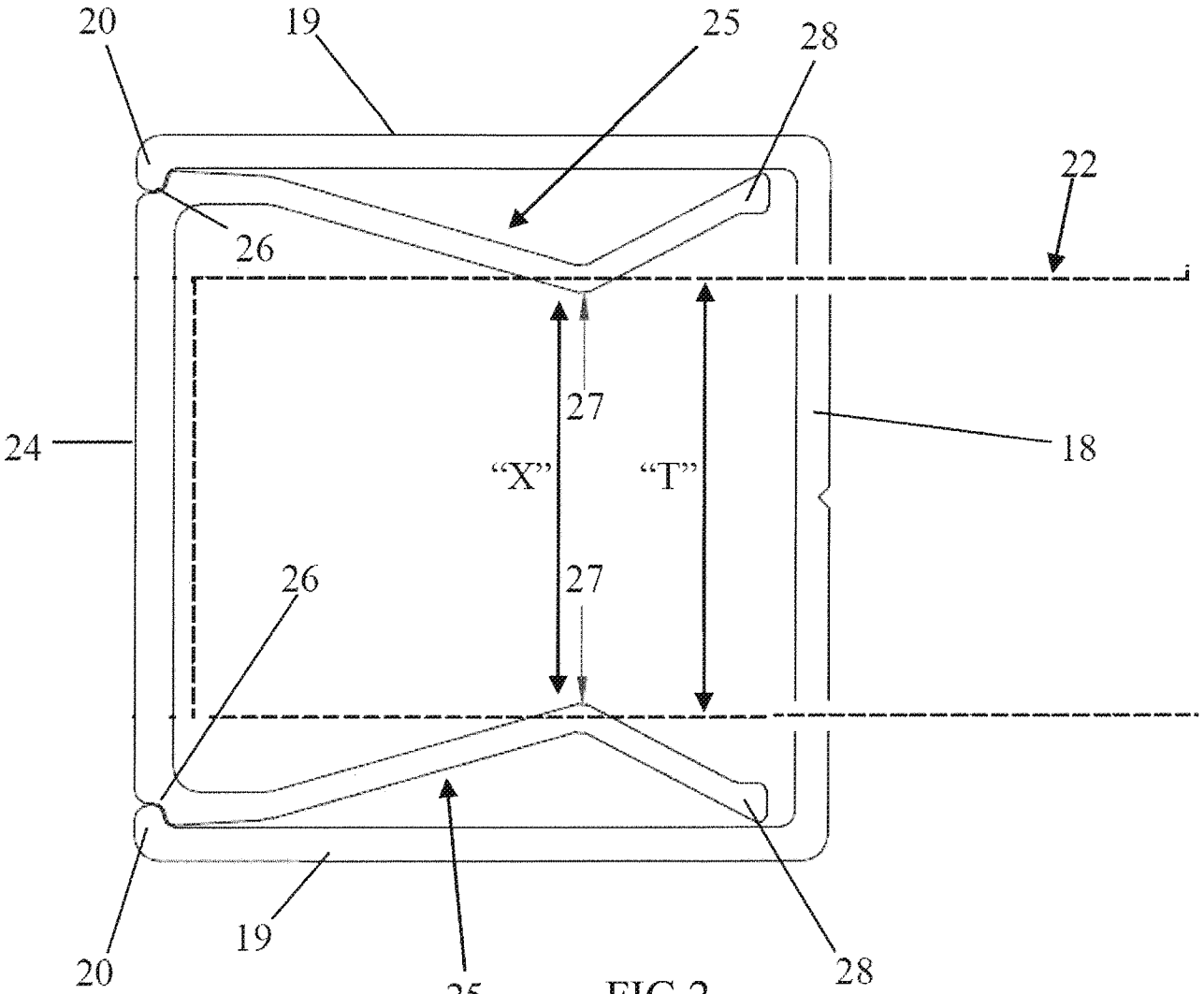
FIG. 2. Illustrates a section view of a post according to the embodiment of the invention and an attached slat.

Referring now to FIGS. 1 and 2, these illustrate an embodiment of the invention which comprises a specially designed two-part post which overcomes the number of disadvantages with existing fit together panels. The various posts that will be described according to embodiments of the invention make use of "snap fit" joints. A snap fit or "snap lock" or sometimes as it is called a "press fit" joint is a joint which is self-locking and which requires no additional fasteners such as screws or rivets to hold the joint together. The mating parts of a snap-fit joint exert a cam action on each other, flexing until one part slips past a raised lip on the other part. Once past this lip, the flexed parts snap back to their normal shape and the lip prevents them from separating. Once snap fitted together the joint cannot usually be unintentionally dissembled.

The post 15 comprises a base member 17 and a cover member 16. In the embodiment, each of these is formed from extruded aluminum. Cover member 16 is substantially C shaped and comprises a base wall 18 and a pair of sidewalls 19 this being best illustrated in FIG. 2. The outer edge of each side wall 19 contains a small turned in lip 20 which forms part of the snap fitting means and which will be described in greater detail below.

Base wall 18 (see FIG. 3) is formed with a number of punched out openings 21 to accommodate edges of slats 22.

Base member 17 is similar to cover member 16 in that it is also substantially U-shaped or C shaped and comprises a bottom wall 24 (see FIG. 4) and opposed sidewalls 25. Base member 17 is sized to fit within cover member 16, or put differently, cover member 16 can snap fit over the sidewalls 25 of base member 17. The peripheral edge of bottom wall 24 contains a small rebate 26 which forms the other parts of the snap fitting means such that the cover member 16 can be snapped over base member 17 by the turned in lips 20 on cover member 16 engaging against the rebate 26 on the peripheral edge on bottom wall 24 of base member 17. It can be seen that cover member 16 can substantially conceal base member 17 to provide an aesthetically pleasing effect.

The sidewalls 25 of each base member 17 are shaped to converge towards an apex 27 and thence to diverge outwardly and away from each other. The apex 27 comprises a turned in portion which forms a clamping leg on each side wall 25. The opposed turned in portions function to clamp a slat therebetween. The sidewalls 25 diverge outwardly from the turned in portion 27 to the outermost edge 28 of each side wall. The diverging portions of the sidewalls 25 facilitate entry of a slat 22.

A slat 22 can be pushed through one of the openings 21 in cover member 16. As the slat passes through the opening 21 will be guided by the diverging portion to push against the turned in portion 27 and to push these portions outwardly as the thickness of the slat "T" is greater than the distance "X" between the turned in portions. This causes the slat to be securely clamped between the sidewalls 25 which comprise clamping legs.

The entire side wall 25 can form the clamping leg with the turned in portion forming the contact area and the remainder of the side wall providing the required bias or clamping force. As the side wall is turned in from the bottom wall 24, this provides a good reliable and long-lasting "memory" to each clamping leg.

The slat is usually pushed through the opening 21 such that the edge of the slat sits against or closely spaced from the bottom wall 24 such that each turned in portion 27 can properly clamp against a respective side wall of slat 22 and at a position spaced some distance from the edge of the slat.

A panel can be easily snap fitted together by providing a pair of posts 15 and inserting the slats into the openings on each post 15 with the slats being clamped in place between an adjacent pair of clamping legs 27. The base member 17 can be screwed or otherwise attached to a supporting post (if required) and the cover member 16 can then be snapped fitted to the base member to provide an aesthetically pleasing finish and completely concealing all the fixing screws to the supporting post. A damaged slat 22 can be removed by uncapping cover member 16 and it is not necessary to remove base member 17. Different types of cover member 16 can be attached to a common base member 17 which can reduce assembly cost. The openings 21 in cover member 16 can be quickly and inexpensively formed using a punch process. The large clamping legs (suitably comprising each entire side wall of base member 17) provide a good clamping force and will function reliably over a long period.

Figure 3:
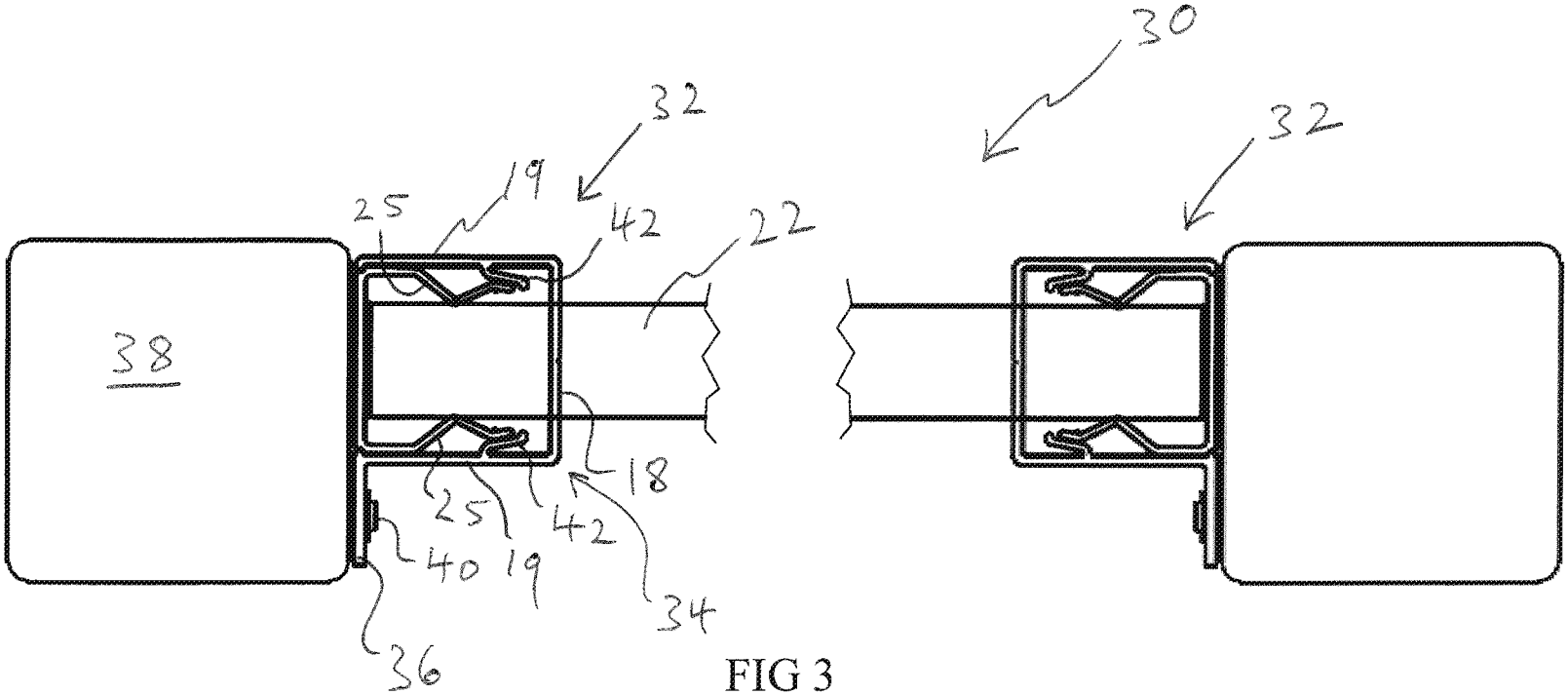
FIG. 3. Is a top view of a fence comprising a slat and posts according to a further embodiment of the present invention.
Figure 4:
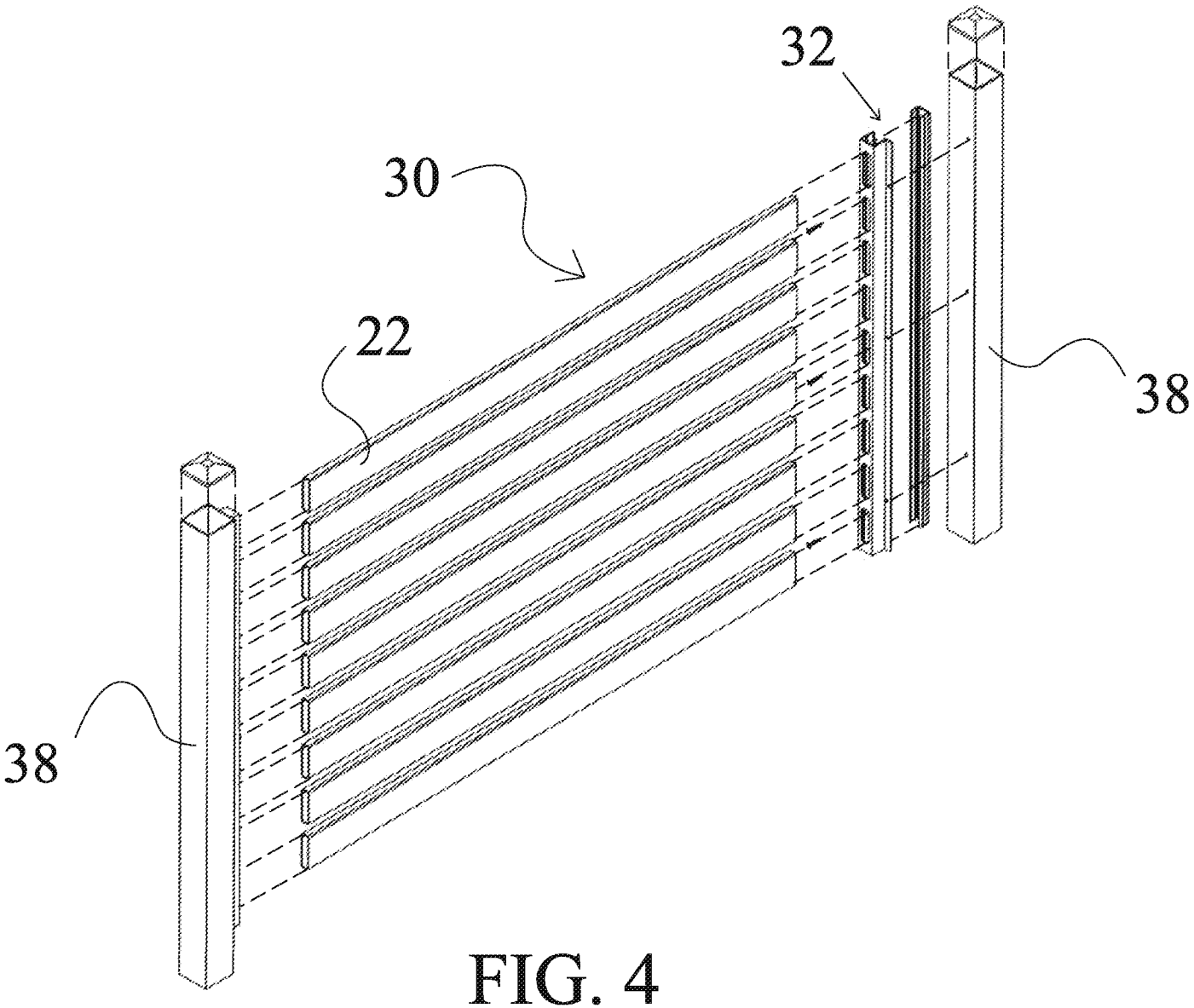
FIG. 4. Is an exploded isometric view of the fence of FIG. 3.

Referring now to FIGS. 3 and 4 there are presented top plan and isometric exploded views of a fence 30 according to a further embodiment of the present invention. As may be seen in FIG. 3, the post 32 that is used in this embodiment includes a cover 34 that has a cover member 18 and side members 19 as for the embodiment of FIG. 2. However the post 32 has a wing 36 that extends laterally from one of the side walls 19 and which is used to fasten the post 32 to a support structure 38 by means of fastener 40. The post 32 also includes internal wings 42 which are integrally formed on the interior of the sidewalls 19 and which assist the clamping legs 25 to clamp the 3rd member, in the form of slat 22, therebetween.

Figure 5:
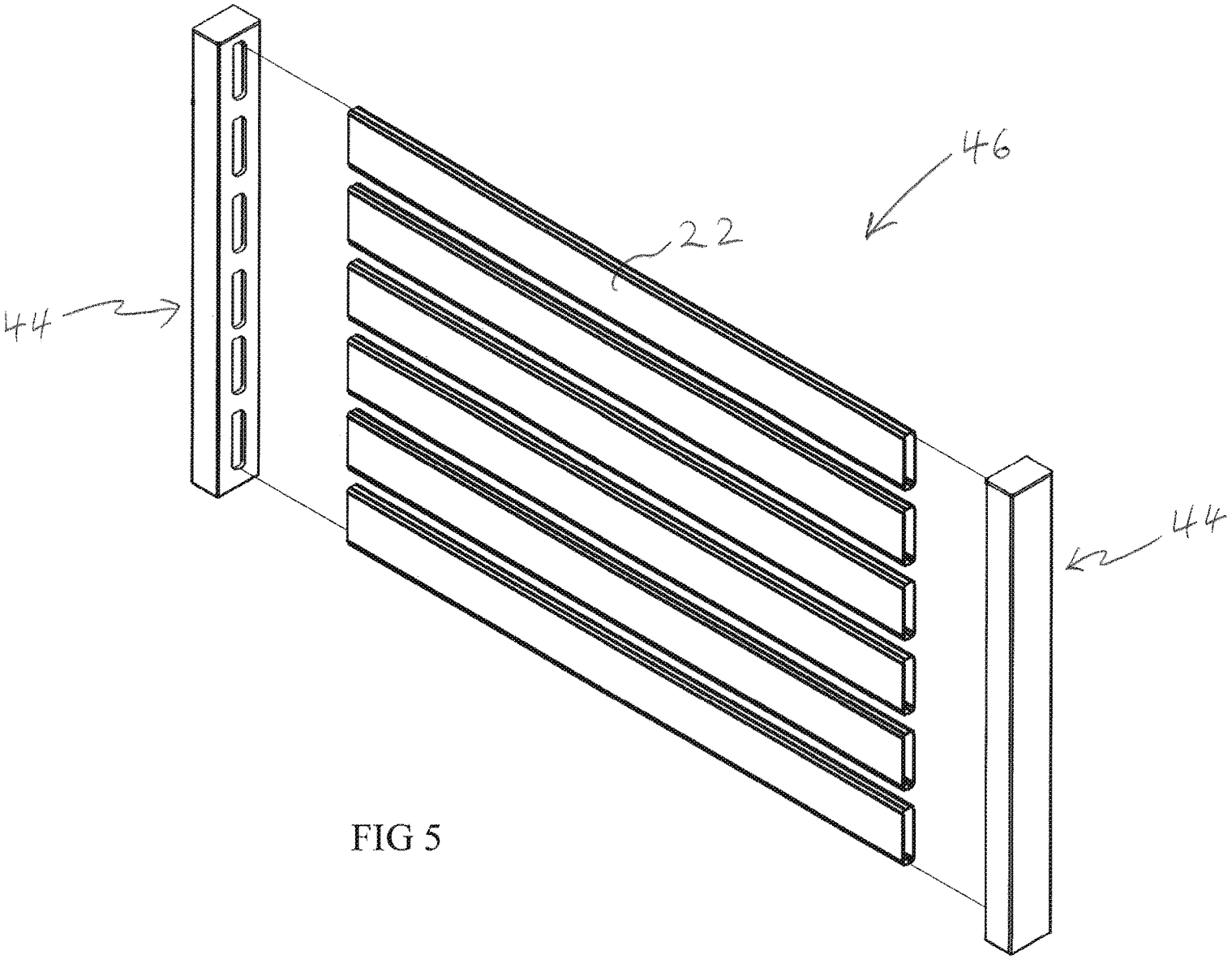
FIG. 5. Is an exploded isometric view of a fence according to a further embodiment of the present invention.
Figure 6:
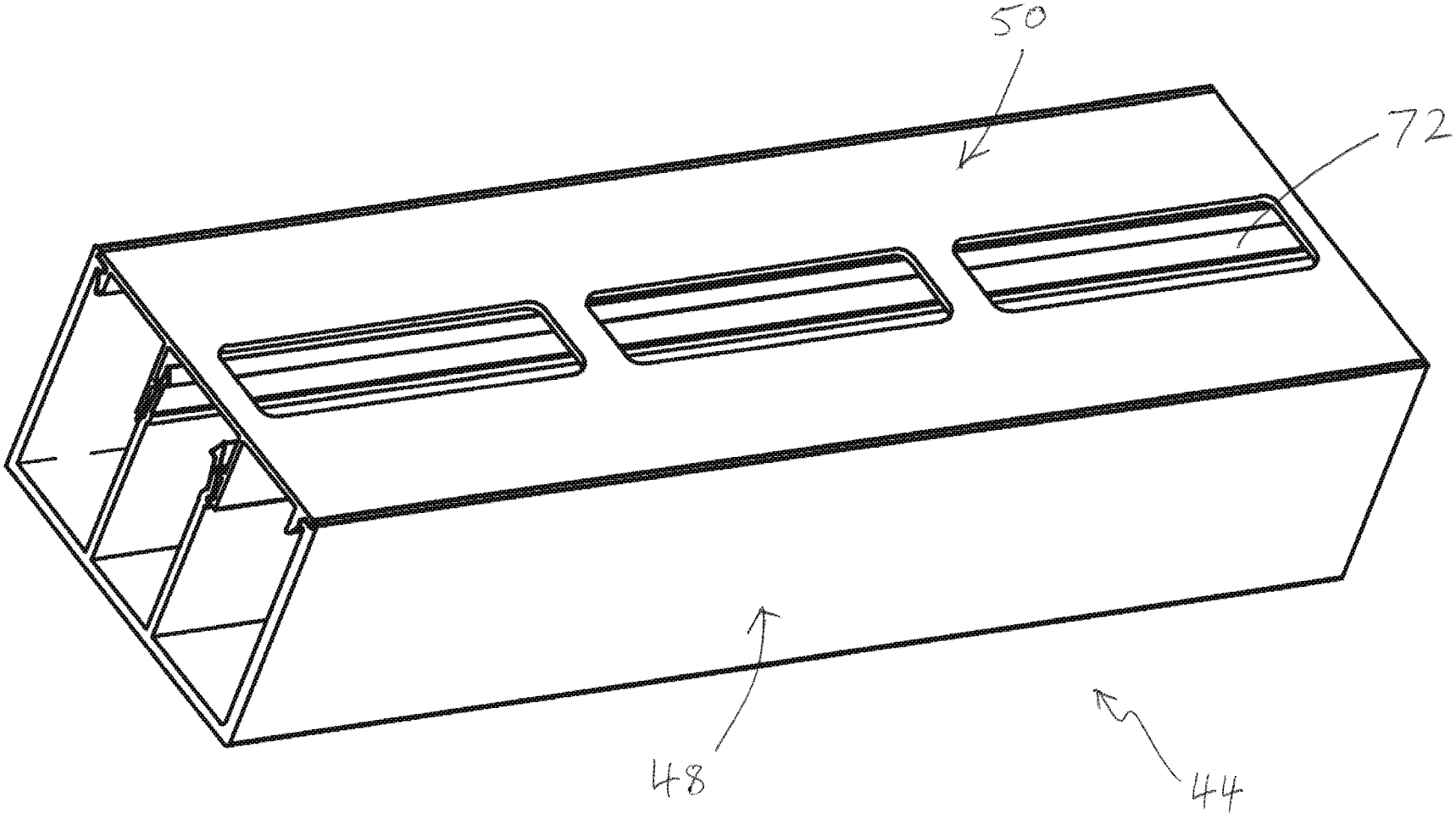
FIG. 6. Is an isometric view of a portion of a post of the fence of FIG. 5 according an embodiment of the present invention.

FIGS. 5 and 6 respectively depict a further fence panel assembly 46 and a further post 44 that is used in that fence panel assembly, according to another embodiment of the present invention.

Figure 7:
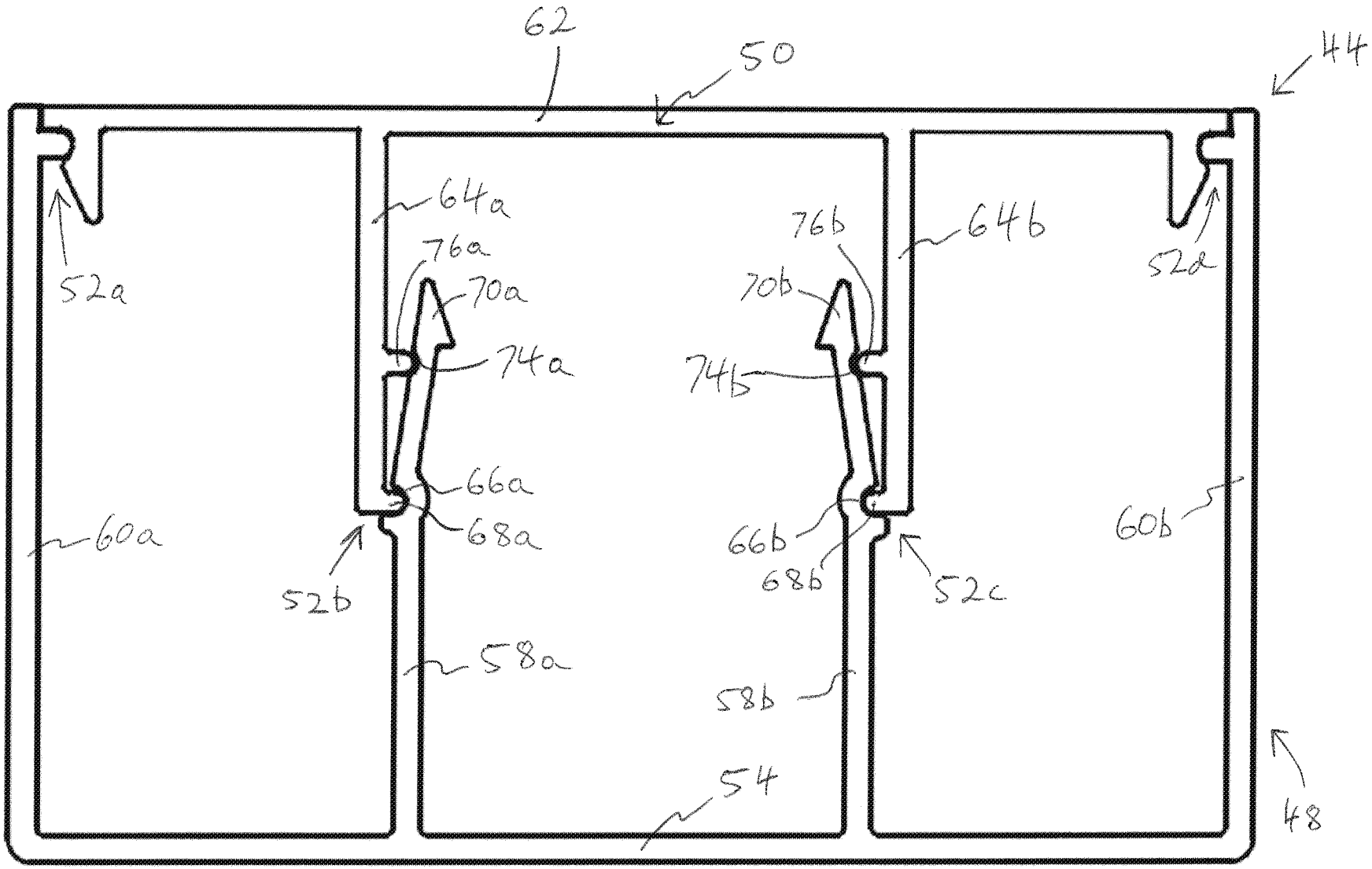
FIG. 7. Is an end view of the post of FIG. 6 illustrating the engagement of the two portions of the post.

FIG. 7 is an end view of the post 44 of FIG. 6. It can be seen from FIG. 7 that the post 44 comprises a base 48 that is snap fitted to cover member 50 by snap fit joints 52*a*, . . . , 52*d*.

The base 48 includes a base wall 54 from which first and second clamping legs 58*a*, 58*b* extend. It further includes first and second sidewalls 60*a*, 60*b* which extend from opposed sides of the base wall 54 with the first and second clamping legs 58*a*, 58*b* being located between the first and second sidewalls 60*a*, 60*b*.

It will be observed that remote ends of the first and second sidewalls 60*a*, 60*b* are snap fitted to opposed sides of the cover 50 by snap fit joints 52*a*, 52*d*.

The cover 50 includes an end wall 62 from which buttressing walls 64*a* and 64*b* project. The buttressing walls 64*a*, 64*b* and the clamping legs 58*a* and 58*b* are joined by snap fit joints 52*b* and 52*c*. The snap fit joints 52*b* and 52*c* are due to the clamping legs 58*a*, 58*b* being formed with outwardly disposed first grooves 66*a*, 66*b*, that receive corresponding inwardly projecting first lips 68*a*, 68*b* of the buttressing walls 64*a*, 64*b*.

The first and second clamping legs 58*a*, 58*b* terminate remotely in respective tapered heads 70*a*, 70*b* to assist in guiding a third member to be clamped there between in use. The third member, e.g a slat 22, enters through an opening 72 (visible in FIG. 6) formed through the cover 50. The first and second clamping legs 58*a* and 58*b* are also formed with second outwardly disposed grooves 74*a*, 74*b* that engage with corresponding inwardly projecting second lips 76*a*, 76*b* of the buttressing walls 64*a*, 64*b* during clamping of the third member.

As the third member, e.g. slat 22, is inserted through opening 72 its end proceeds between tapered heads 70*a* and 70*b* thereby abutting the heads and causing the heads to swing outwardly until they are stopped by the abutment of the second lips 76*a* and 76*b* with the second grooves 74*a*, 74*b*. It will therefore be understood that the normal, unclamping, distance between the tapered heads is a little less than the width of the slat that is to be clamped therebetween.

Figure 8:
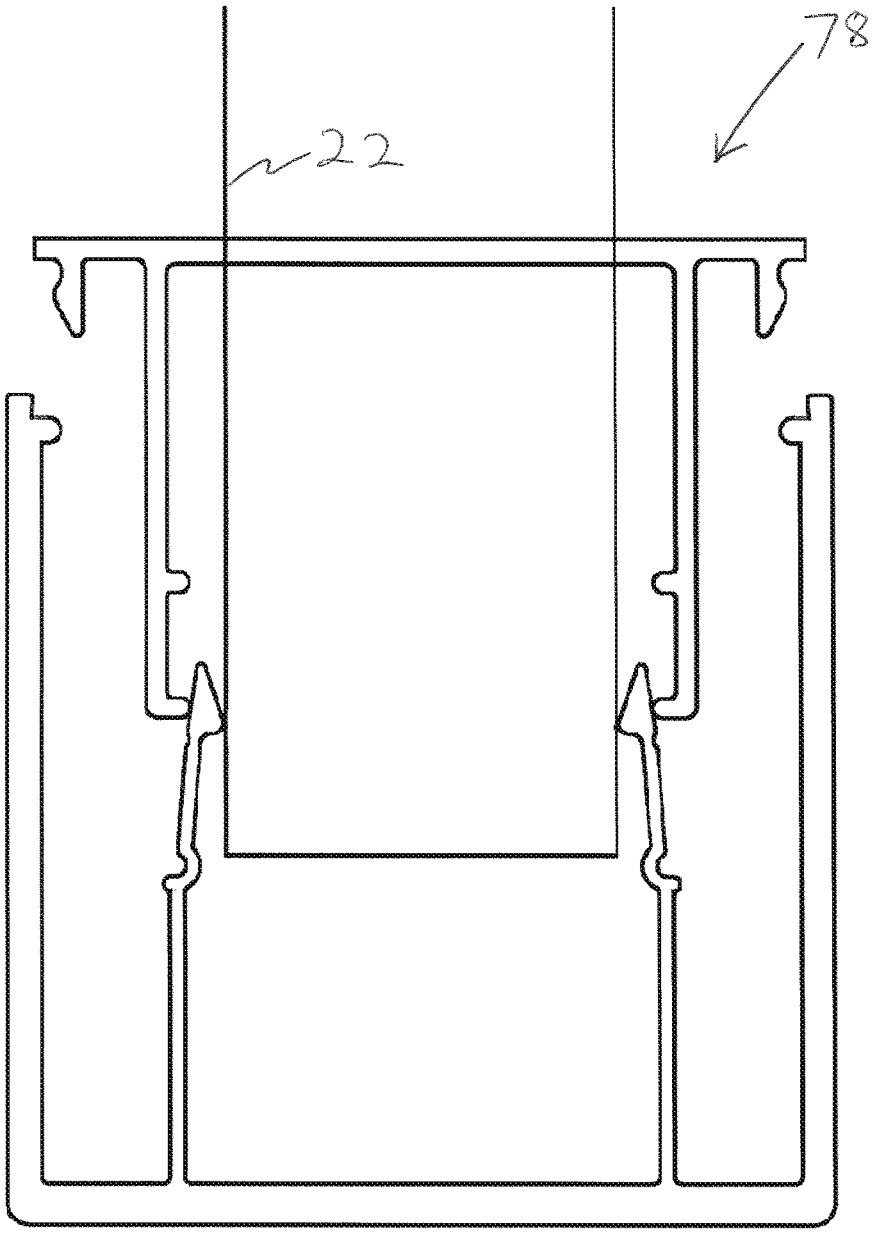
FIG. 8. Is an end view of a narrower version of the post of FIG. 7 showing the two parts prior to their engagement together.
Figure 9:
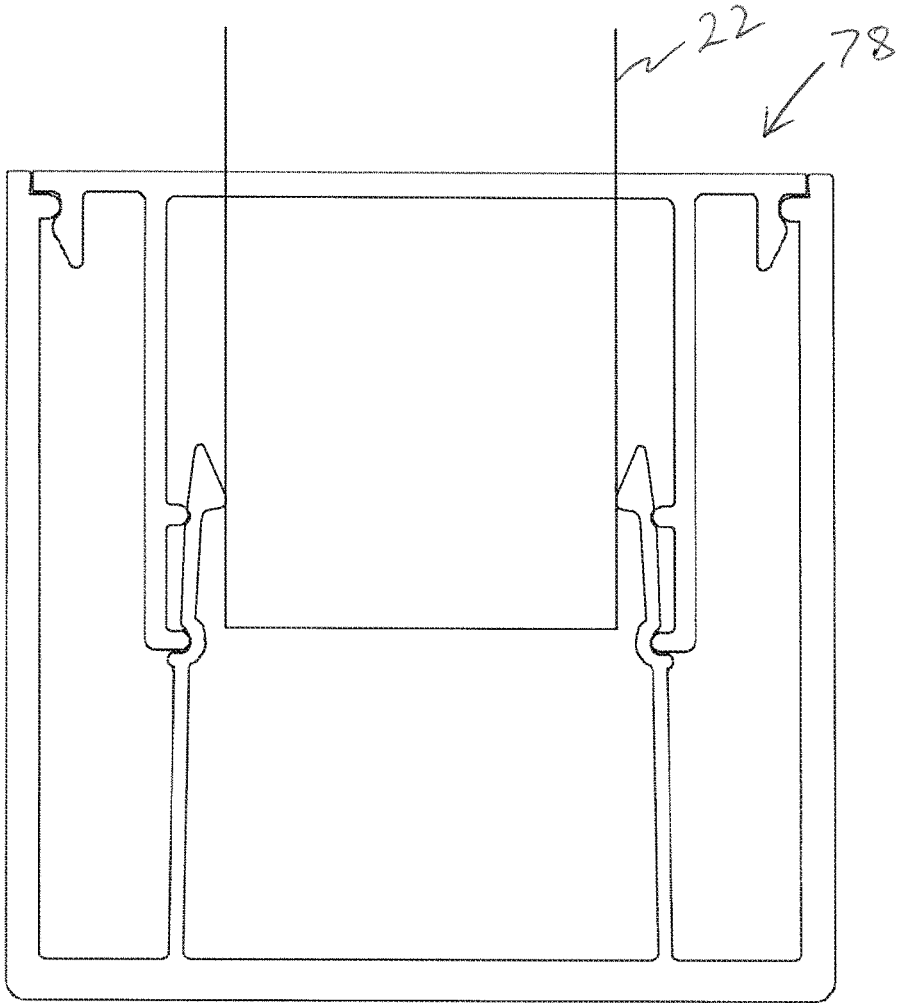
FIG. 9. Is an end view of the post of FIG. 8 subsequent to the engagement of the two parts of the post.

FIGS. 8 and 9 show an exploded and assembled post 78 in use clamping a third member in the form of a post 22. Post 78 is entirely similar to post 48 of FIG. 7 save that it is a little narrower.

Figure 10:
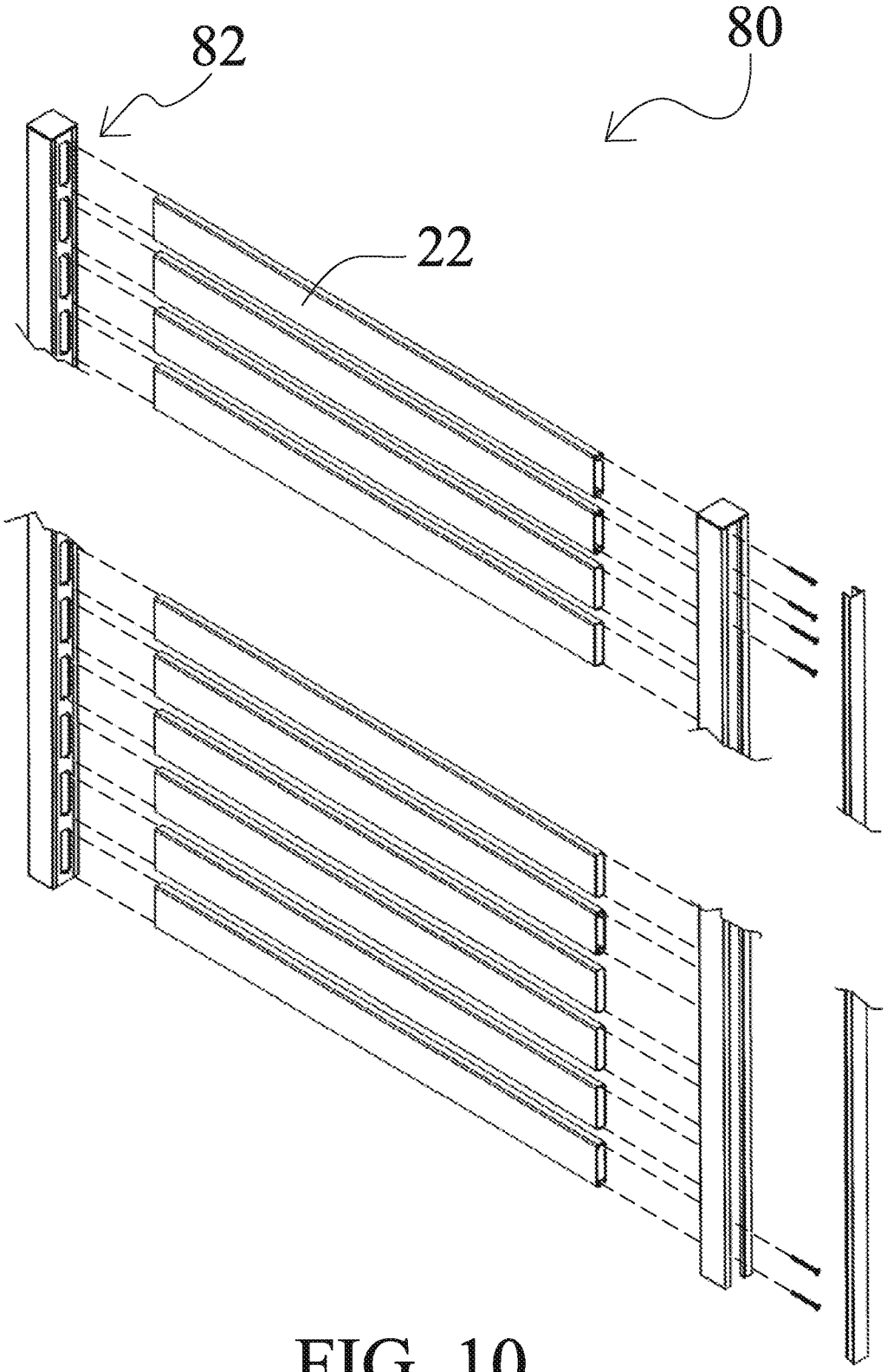
FIG. 10. Is an isometric, exploded view of a post and rail fence according to a further embodiment of the present invention.
Figure 11:
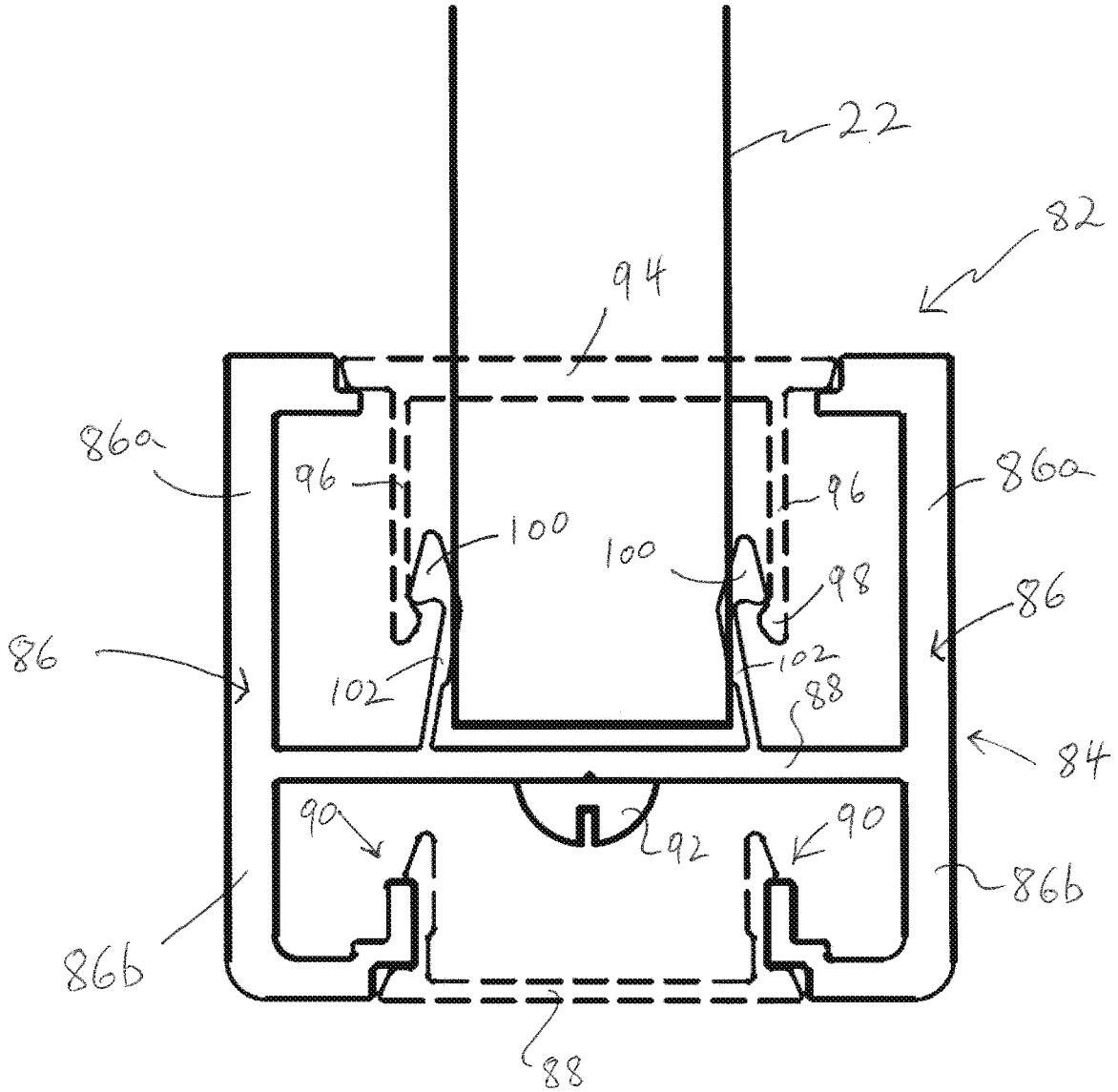
FIG. 11. Is a top plan view of the post of FIG. 10.

FIG. 10 depicts a fence assembly 80 according to a further embodiment of the present invention. The fence assembly 80 makes use of a post 82 according to a further embodiment of the invention which is illustrated in cross section in FIG. 11 receiving an end of a 3rd member in the form of slat 22. It will be observed that the base member 84 is formed with a base wall 88 from which sidewalls 86 extend both forwardly, portions 86*a*, and rearwardly, portions 86*b*. In this embodiment a second cover member 88 spans between the rearward portions 86*b* of the sidewall 86 and is fitted thereto by snap-joints 90. Fasteners such as screw 92 may be provided to secure for example a lockbox in the fence. In that case the second cover member 88 covers fastener 92. A first cover member 94 with buttressing walls 96 is also provided. The buttressing walls 96 have lips 98 that engage the outside of tapered heads 100 of clamping legs 102.

Figure 12:
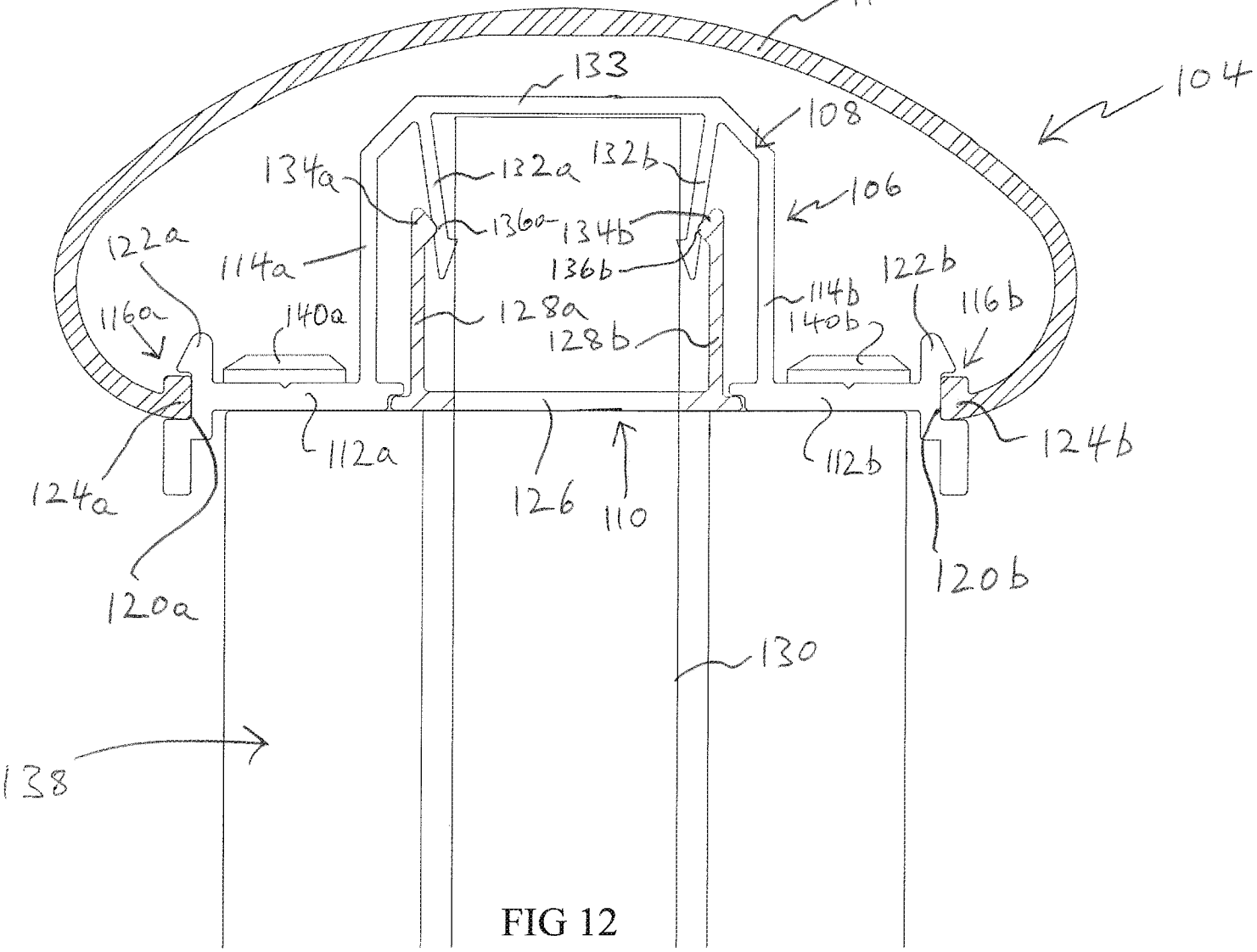
FIG. 12 depicts a balustrade assembly according to an embodiment of the invention.

Referring now to FIG. 12, there is illustrated a balustrade assembly 104 according to a further embodiment of the present invention. Balustrade assembly 104 makes use of a horizontally disposed post 106 according to a further embodiment of the present invention. The post 106 includes a base member 108 and a cover member 110. It will be observed that first and second lateral wings 112*a*, 112*b* extend from distal ends of the first and second sidewalls 114*a*, 114*b* of base member 108. Outer edges of the lateral wings are formed with snap fit formations 116*a*, 116*b* for receiving an edge of a balustrade 118 or other cover. The snap fit formations 116*a*, 116*b* include a slot 120*a*, 120*b* formed as an undercut adjacent tapering ridges 122*a*, 122*b* which assist in installing edges of the balustrade 118 into the slot. The base member 108 locates over the cover member 110.

The base member 108 is formed with clamping legs 132*a*, 132*b* which extend from base wall 133 and which clamp a member 130 therebetween in use. Buttressing walls 128*a*, 128*b* extend from the interior of the end wall 126 of the cover member 110 past and adjacent to the clamping legs 132*a*, 132*b*. The buttressing walls 128*a*, 128*b* are formed with remote, inwardly projecting lips 134*a*, 134*b* which engage with corresponding grooves 136*a*, 136*b* formed along the outsides of the clamping legs. Accordingly, as the member 130 is inserted through an opening in cover member 110 it passes between the clamping legs 132*a* and 132*b* and pushes them outwardly so that the grooves 136*a*, 136*b* engage the lips 134*a* and 134*b* thereby assisting in fastening the base member 108 to the cover member 110 and firmly clamping the member 130. The lateral wings 112*a*, 112*b* are fastened to a structure such as a railing assembly 138, of which member 130 is a constituent by means of screws or other fasteners 140*a*, 140*b*, which extend through lateral wings 112*a*, 112*b*.

The above description identifies at least one specific, substantial and credible use for the invention. For example, preferred embodiments of the invention provide aluminum extrusion posts which are readily attached to each other and which are capable of clamping members such as fence slats.

In compliance with the statute, the invention has been described in language more or less specific to structural or methodical features. The term "comprises" and its variations, such as "comprising" and "comprised of" is used throughout in an inclusive sense and not to the exclusion of any additional features. It is to be understood that the invention is not limited to specific features shown or described since the means herein described comprises preferred forms of putting the invention into effect. The invention is, therefore, claimed in any of its forms or modifications within the proper scope of the appended claims appropriately interpreted by those skilled in the art.

Throughout the specification and claims (if present), unless the context requires otherwise, the term "substantially" or "about" will be understood to not be limited to the value for the range qualified by the terms.

Any embodiment of the invention is meant to be illustrative only and is not meant to be limiting to the invention. Therefore, it should be appreciated that various other changes and modifications can be made to any embodiment described without departing from the spirit and scope of the invention.

Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith.

What is claimed is:

1. A post comprising:

a base member and a cover member having complementary snap fit formations by which said base member and said cover member may be secured to each other, said base member including an end wall and opposing first and second walls that extend away from said end wall, said first and second walls each having a distal end portion that includes an inclined face and wherein said inclined faces converge towards one other so as to form a throat having opposed throat portions that define a narrow continuous opening;

said cover member including an end wall with spaced apart first and second side walls extending therefrom and wherein said first and second side walls at least partially extend over an adjacent one of said distal end portions;

at least one opening formed through said end wall of said base member and/or said end wall of said cover member, said one or more openings being adapted to receive therein an end portion of one or more slats or rails, whereby, after having secured said base member to said cover member using said snap fit formations, the end portion of the slat or rail may then be extended through said opening in said end wall and guided by said inclined faces through said narrow elongate opening towards said other end wall, and wherein the end portion will be frictionally retained between opposed throat portions by the engagement of said distal end portions with said side walls and/or end wall of said cover.

2. A post according to claim 1, wherein said first and second side walls each include a first wall portion that extends away from said end wall and generally converges towards the other and a second wall portion that extends away from said first wall portion and which diverges away from the other, and wherein said first wall portion is located between said second end portion and said end wall.

3. A post according to claim 2, wherein said second wall portions each terminate in a distal end portion and, when said base member is secured to said cover member, shall engage an adjacent side wall or end wall of said cover member.

4. A post according to claim 1, wherein said narrow continuous opening is defined by a portion of each of said first and second legs where said first wall portion transitions into said second wall portion.

5. A post according to claim 4, wherein said snap fit formations include inwardly projecting lips formed along said first and said second side walls of said cover member and complimentary rebates formed in outer edge portions of said end wall of said base member.

6. A post according to claim 4, wherein said first and second side walls of said base member are formed with outwardly disposed first grooves that receive corresponding inwardly projecting first lips of said first and second side walls of said cover member.

7. A post according to claim 1, wherein said base member and said cover member comprise aluminium extrusions.

8. A fence panel assembly comprising a pair of posts according to claim 1 with a plurality of slats disposed therebetween and with opposed ends of the slats being respectively clamped between first and second walls of each of said base members.

9. A post according to claim 1, wherein said first and second side walls each include a first wall portion that extends away from said end wall and which are generally parallel to one another and a second wall portion that extends away from said first wall portion and which converges towards the other, and wherein said first wall portion is located between said second wall portion and said end wall, and wherein when said base member is secured to said cover member, each of said second wall portions shall engage an adjacent side wall of said cover member.

10. A post according to claim 9, wherein said second wall portions each terminate in a distal end portion having an inclined face that defines said throat.

11. A post according to claim 10, wherein said narrow continuous opening is defined by a portion of each of said distal end portions.

12. A post according to claim 9, wherein said snap fit formations include inwardly projecting lips formed along said first and said second side walls of said cover member and complimentary rebates formed in outer edge portions of said end wall of said base member.

13. A post according to claim 9, wherein said first and second side walls of said base member are formed with outwardly disposed first grooves that receive corresponding inwardly projecting first lips of said first and second side walls of said cover member.

* * * * *